US008814164B2

(12) United States Patent
Baker et al.

(10) Patent No.: US 8,814,164 B2
(45) Date of Patent: Aug. 26, 2014

(54) APPARATUSES AND METHODS FOR CONTINUOUSLY SUPPLYING SETS OF CARDS FOR A CARD GAME

(71) Applicant: SHFL entertainment, Inc., Las Vegas, NV (US)

(72) Inventors: Thompson Baker, Meridian, ID (US); Steven J. Blad, Henderson, NV (US); Lynn Hessing, Boise, ID (US); Phil Price, Boise, ID (US); Carl W. Price, Boise, ID (US)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

(21) Appl. No.: 13/898,165

(22) Filed: May 20, 2013

(65) Prior Publication Data

US 2013/0256989 A1 Oct. 3, 2013

Related U.S. Application Data

(60) Continuation of application No. 12/715,326, filed on Mar. 1, 2010, now Pat. No. 8,444,146, which is a continuation of application No. 11/419,731, filed on May 22, 2006, now Pat. No. 7,669,852, which is a division of application No. 10/887,062, filed on Jul. 8, 2004, now Pat. No. 7,461,843, which is a continuation-in-part of application No. 10/757,785, filed on Jan. 14, 2004, now Pat. No. 6,959,925, which is a continuation of application No. 10/226,394, filed on Aug. 23, 2002, now Pat. No. 6,698,756.

(51) Int. Cl.
*A63F 1/12* (2006.01)

(52) U.S. Cl.
USPC ..... 273/149 R

(58) Field of Classification Search
USPC ..... 273/149 R
See application file for complete search history.

(56) References Cited

U.S. PATENT DOCUMENTS

| | | | |
|---|---|---|---|
| 2,755,090 | A | 7/1956 | Aldrich |
| 3,589,730 | A | 6/1971 | Slay |
| 3,705,548 | A | 12/1972 | Waterman |
| 3,861,261 | A | 1/1975 | Maxey et al. |
| 4,043,661 | A | 8/1977 | Yamada et al. |

(Continued)

OTHER PUBLICATIONS

Google Patent Search for 5584483, http://www.google.com/?tbm=pts&hl=en, dated Jun. 14, 2012, 2 pages.

(Continued)

*Primary Examiner* — Kurt Fernstrom
*Assistant Examiner* — Dolores Collins
(74) *Attorney, Agent, or Firm* — TraskBritt

(57) ABSTRACT

An apparatus for randomly arranging and dealing a plurality of playing cards includes a device for moving cards and randomly ejecting playing cards from an initial set of playing cards located in a card input unit for an initial delivery of randomly arranged playing cards to a card delivery unit. The card delivery unit includes upper powered rollers and lower powered belts for receiving and transporting the playing cards through the card delivery unit and into a card collection unit. A playing card limiter is adjustable to allow a greater number or a lesser number of cards to pass from the card delivery unit to the card collection unit. Methods of randomly arranging and dealing a plurality of playing cards may include related apparatus.

21 Claims, 13 Drawing Sheets

(56) References Cited

U.S. PATENT DOCUMENTS

| | | | | |
|---|---|---|---|---|
| 4,072,304 | A | 2/1978 | Brown et al. | |
| 4,310,160 | A | 1/1982 | Willette | |
| 4,310,180 | A | 1/1982 | Mowry, Jr. et al. | |
| 4,421,501 | A | 12/1983 | Scheffer | |
| 4,497,488 | A | 2/1985 | Plevyak et al. | |
| 4,512,580 | A | 4/1985 | Matviak | |
| 4,513,968 | A * | 4/1985 | Okada | 273/143 R |
| 4,513,969 | A * | 4/1985 | Samsel, Jr. | 273/149 R |
| 4,515,367 | A | 5/1985 | Howard | |
| 4,526,364 | A | 7/1985 | Evans et al. | |
| 4,586,712 | A | 5/1986 | Lorber et al. | |
| 4,659,082 | A | 4/1987 | Greenberg | |
| 4,667,959 | A | 5/1987 | Pfeiffer et al. | |
| 4,706,984 | A | 11/1987 | Esler | |
| 4,770,421 | A | 9/1988 | Hoffman | |
| 4,807,884 | A | 2/1989 | Breeding | |
| 5,067,713 | A | 11/1991 | Soules et al. | |
| 5,275,411 | A | 1/1994 | Breeding | |
| 5,303,921 | A | 4/1994 | Breeding | |
| 5,356,145 | A | 10/1994 | Verschoor | |
| 5,374,061 | A | 12/1994 | Albrecht et al. | |
| 5,584,483 | A | 12/1996 | Sines et al. | |
| 5,605,334 | A | 2/1997 | McCrea et al. | |
| 5,617,196 | A | 4/1997 | Ueda et al. | |
| 5,657,709 | A | 8/1997 | Miyachi et al. | |
| 5,676,372 | A | 10/1997 | Sines et al. | |
| 5,683,085 | A | 11/1997 | Johnson et al. | |
| 5,707,287 | A | 1/1998 | McCrea et al. | |
| 5,718,427 | A | 2/1998 | Cranford et al. | |
| 5,719,288 | A | 2/1998 | Sens et al. | |
| 5,722,893 | A | 3/1998 | Hill et al. | |
| 5,735,525 | A | 4/1998 | McCrea et al. | |
| 5,779,546 | A | 7/1998 | Meissner et al. | |
| 5,810,355 | A | 9/1998 | Trilli | |
| 5,813,326 | A | 9/1998 | Salomon et al. | |
| 5,814,796 | A | 9/1998 | Benson et al. | |
| 5,816,569 | A | 10/1998 | Hoshi et al. | |
| 5,889,979 | A | 3/1999 | Miller et al. | |
| 6,019,368 | A | 2/2000 | Sines et al. | |
| 6,068,258 | A | 5/2000 | Breeding et al. | |
| 6,093,103 | A | 7/2000 | McCrea et al. | |
| 6,117,012 | A | 9/2000 | McCrea et al. | |
| 6,139,014 | A | 10/2000 | Breeding et al. | |
| 6,149,154 | A | 11/2000 | Grauzer et al. | |
| 6,250,532 | B1 | 6/2001 | Green et al. | |
| 6,250,632 | B1 | 6/2001 | Albrecht | |
| 6,254,096 | B1 * | 7/2001 | Grauzer et al. | 273/149 R |
| 6,293,546 | B1 | 9/2001 | Hessing et al. | |
| 6,299,167 | B1 | 10/2001 | Sines et al. | |
| 6,308,886 | B1 | 10/2001 | Benson et al. | |
| 6,315,587 | B1 | 11/2001 | Ikemoto et al. | |
| 6,325,373 | B1 | 12/2001 | Breeding et al. | |
| 6,361,044 | B1 | 3/2002 | Block et al. | |
| 6,369,882 | B1 | 4/2002 | Bruner et al. | |
| 6,531,172 | B2 | 3/2003 | Perrine | |
| 6,572,097 | B2 | 6/2003 | d'Agrella et al. | |
| 6,582,301 | B2 | 6/2003 | Hill | |
| 6,585,301 | B1 | 7/2003 | Prevot | |
| 6,588,751 | B1 | 7/2003 | Grauzer et al. | |
| 6,629,894 | B1 | 10/2003 | Purton | |
| 6,644,253 | B2 | 11/2003 | Haskara et al. | |
| 6,651,982 | B2 * | 11/2003 | Grauzer et al. | 273/149 R |
| 6,655,684 | B2 | 12/2003 | Grauzer et al. | |
| 6,659,460 | B2 | 12/2003 | Blaha et al. | |
| 6,676,127 | B2 | 1/2004 | Johnson et al. | |
| 6,698,756 | B1 * | 3/2004 | Baker et al. | 273/149 R |
| 6,719,288 | B2 | 4/2004 | Hessing et al. | |
| 6,726,205 | B1 | 4/2004 | Purton | |
| 6,886,829 | B2 | 5/2005 | Hessing et al. | |
| 6,889,979 | B2 | 5/2005 | Blaha | |
| 6,959,925 | B1 * | 11/2005 | Baker et al. | 273/149 R |
| 6,988,516 | B2 | 1/2006 | Debaes et al. | |
| 7,028,598 | B2 | 4/2006 | Teshima | |
| 7,036,818 | B2 * | 5/2006 | Grauzer et al. | 273/149 R |
| 7,066,464 | B2 * | 6/2006 | Blad et al. | 273/149 R |
| 7,261,294 | B2 | 8/2007 | Grauzer et al. | |
| 7,461,843 | B1 * | 12/2008 | Baker et al. | 273/149 R |
| 7,556,195 | B2 | 7/2009 | Ishii | |
| 7,594,660 | B2 | 9/2009 | Baker et al. | |
| 7,644,923 | B1 * | 1/2010 | Dickinson et al. | 273/149 R |
| 7,669,852 | B2 * | 3/2010 | Baker et al. | 273/149 R |
| 7,677,565 | B2 * | 3/2010 | Grauzer et al. | 273/149 R |
| 7,735,657 | B2 * | 6/2010 | Johnson | 209/552 |
| 7,753,373 | B2 * | 7/2010 | Grauzer et al. | 273/149 R |
| 7,766,332 | B2 * | 8/2010 | Grauzer et al. | 273/149 R |
| 7,769,232 | B2 * | 8/2010 | Downs, III | 382/181 |
| 7,976,023 | B1 | 7/2011 | Hessing et al. | |
| 2002/0017481 | A1 | 2/2002 | Johnson et al. | |
| 2002/0063389 | A1 | 5/2002 | Breeding et al. | |
| 2002/0068635 | A1 | 6/2002 | Hill | |
| 2002/0163125 | A1 | 11/2002 | Grauzer et al. | |
| 2003/0042673 | A1 | 3/2003 | Grauzer et al. | |
| 2003/0052449 | A1 | 3/2003 | Grauzer et al. | |
| 2003/0052450 | A1 | 3/2003 | Grauzer et al. | |
| 2003/0063460 | A1 | 4/2003 | Nadel | |
| 2003/0073498 | A1 | 4/2003 | Grauzer et al. | |
| 2003/0075866 | A1 | 4/2003 | Blaha et al. | |
| 2003/0090059 | A1 | 5/2003 | Grauzer et al. | |
| 2003/0094756 | A1 | 5/2003 | Grauzer et al. | |
| 2004/0036214 | A1 | 2/2004 | Baker et al. | |
| 2004/0067789 | A1 | 4/2004 | Grauzer et al. | |
| 2005/0110211 | A1 | 5/2005 | Blad et al. | |
| 2005/0206077 | A1 * | 9/2005 | Grauzer et al. | 273/149 R |
| 2006/0066048 | A1 | 3/2006 | Krenn et al. | |
| 2007/0267811 | A1 * | 11/2007 | Yoseloff et al. | 273/149 P |

OTHER PUBLICATIONS

International Search Report for International Application No. PCT/US2003/26113, dated Dec. 29, 2003.

* cited by examiner

APPARATUSES AND METHODS FOR CONTINUOUSLY SUPPLYING SETS OF CARDS FOR A CARD GAME

CROSS-REFERENCE TO RELATED APPLICATIONS

This application is a continuation of U.S. patent application Ser. No. 12/715,326, filed Mar. 1, 2010, now U.S. Pat. No. 8,444,146, issued May 21, 2013, which is a continuation of U.S. patent application Ser. No. 11/419,731, filed May 22, 2006, now U.S. Pat. No. 7,669,852, issued Mar. 2, 2010, which is a divisional of U.S. patent application Ser. No. 10/887,062, filed Jul. 8, 2004, now U.S. Pat. No. 7,461,843, issued Dec. 9, 2008, which, in turn, is a continuation-in-part of U.S. patent application Ser. No. 10/757,785, filed Jan. 14, 2004, now U.S. Pat. No. 6,959,925, issued Nov. 1, 2005, which, in turn, is a continuation of U.S. patent application Ser. No. 10/226,394, filed Aug. 23, 2002, now U.S. Pat. No. 6,698,756, issued Mar. 2, 2004, the disclosure of each of which is hereby incorporated in its entirety herein by this reference.

FIELD OF THE INVENTION

The present invention relates to devices for shuffling playing cards for facilitating the play of casino wagering games. More particularly, an electronically controlled card shuffling apparatus includes a card input unit for receipt of an unshuffled stack of playing cards, a card ejection unit, a card separation and delivery unit and a collector unit for receipt of shuffled cards.

BACKGROUND

Automatic card shuffling machines were first introduced by casinos approximately ten years ago. Since then, the machines have, for all intents and purposes, replaced manual card shuffling. To date, most automatic shuffling machines have been adapted to shuffle one or more decks of standard playing cards for use in the game of blackjack. However, as the popularity of legalized gambling has increased, so too has the demand for new table games utilizing standard playing cards. As a result, automatic shuffling machines have been designed to now automatically "deal" hands of cards once the cards have been sufficiently rearranged.

For example, U.S. Pat. No. 5,275,411 ("the '411 patent") to Breeding and assigned to Shuffle Master, Inc., describes an automatic shuffling and dealing machine. The '411 patent describes an automatic method of interleaving cards as traditionally done in a manual fashion. Once interleaved, the entire stack of shuffled cards is positioned above a roller that removes and expels a predetermined number of cards from the bottom of the stack to a card shoe. Once the predetermined number of expelled cards are removed from the shoe by a dealer, a second set of cards is removed and expelled. This is repeated until the dealer has dealt each player his or her cards and has instructed (e.g., pressed a button on the shuffler) the shuffling machine to expel the remaining cards of the stack.

The '411 patent and related shufflers, having a dealing means, suffer from the same shortcomings—slowness, misdeals and failure. However, the machines currently marketed are still favored over manual card shuffling. On the other hand, since casino revenue is directly proportional to the number of plays of each wagering game on its floor, casinos desire and, in fact, demand that automatic card shufflers work quickly, reliably and efficiently.

Accordingly, the present invention utilizes a proprietary random card ejection technique, in combination with a novel card separation and delivery unit, to overcome the aforementioned shortcomings. The present invention uses random ejection technology to dispense individual cards from a card input unit to a card separation and delivery unit of the shuffler. A card stop arm and floating gate control the number of ejected cards that may, at any one time, travel to the card separation and delivery unit. The ejected cards are then separated by a feed roller system which propels the cards to a collection unit. Once a predetermined number of cards are propelled to the collection unit, additional cards are ejected from the card input unit. A shuffler processing unit in communication with internal sensors controls the operation of the shuffler.

An audio system is adapted to communicate internal shuffler problems and shuffler instructions to an operator. Preferably, the audio system is controlled by the shuffler processing unit in communication with a second local processing unit.

SUMMARY

While the objects of the present invention are too numerous to list, several objects are listed herein for reference.

A principal object of the present invention is to provide a reliable and quick card shuffler for poker style card games.

Another object of the present invention is to provide operators with audio outputs of the shuffler's status during use.

Another object of the present invention is to provide operators with audio outputs of shuffler instructions during shuffler use.

Another object of the present invention is to utilize random ejection technology in a shuffler having a means for delivering card hands.

Another object of the present invention is to provide a shuffler having a card delivery means that infrequently, if ever, misdeals (e.g., deals four cards instead of three) or jams.

Another object of the present invention is to decrease the time wasted between deals of any card-based table game.

Another object of the present invention is to provide a shuffler eliminating the need to shuffle an entire deck of cards for each play of the underlying game.

Another object of the present invention is to provide a shuffler having means for accepting and delivering cards of multiple sizes.

Yet another object of the present invention is to provide a shuffler that can deliver card hands of multiple sizes (e.g., card hands of two to seven cards).

Other objects will become evident as the present invention is described in detail below.

The objects of the present invention are achieved by a shuffler having a card input unit for receipt of unshuffled stacks of playing cards, a card ejection unit, a card separation and delivery unit, a delivery unit and a collection unit for receipt of shuffled cards.

The card input unit is positioned at the rear of the shuffler and adjacent to three card ejectors that randomly push single cards from the unshuffled stack of cards. The card input unit is mounted on an output shaft of a linear stepper motor in communication with a shuffler microprocessor. The stepper motor randomly positions a tray of the card input unit with respect to fixed card ejectors. Each ejector is then activated in a random order such that three cards are ejected from the deck. Once the three cards are ejected, the card input tray is randomly re-positioned, and the three ejectors are once again activated. This process continues until the necessary number of cards for two hands of the underlying game is ejected. The movement of the ejected cards is facilitated by ejection rollers and a downwardly inclined card-traveling surface leading to a collection point, where ejected cards stack behind a stop arm.

The partially rotatable stop arm is spring-loaded such that a first end opposite the fixed rotatable end applies pressure in a downward direction onto the card-traveling surface having two parallel card separation belts therealong. The stop arm is controlled by a motor and cam arrangement that acts to intermittently raise the first end of the stop arm to allow a predetermined number of cards to pass through to the card separation and delivery unit.

The card separation and delivery unit includes a separation belt system, separation rollers and a floating gate. The separation belt system is comprised of two parallel belts residing in a cut-out portion of the card-traveling surface. The separation rollers are above the belts and clutch the cards, while the belts remove the cards from the bottom of the stack one at time. A floating gate is supported by an elongated member having a first end joined to a first shaft supporting the separation rollers and a second end joined to a second more forward parallel shaft. The floating gate is spaced above the card-traveling surface just rear of the separation rollers and forward of the stop arm so as to prevent no more than two or three cards from fully passing under the stop arm, thereby minimizing misdeals or card jams. A protrusion extending from a bottom portion of the floating gate head is spaced above the card-traveling surface a minimum distance equivalent to the thickness of several playing cards. The floating gate eliminates heretofore common card jams and misdeal occurrences. In the unlikely event of a card jam or misdeal, the present shuffler is equipped with multiple internal sensors for detecting the same. Moreover, the sensors are preferably in communication with an audio output system that alerts an operator of the jam or misdeal. In addition, the audio system may be used to instruct an operator during use of the shuffler.

Once the cards are propelled forward by the separation belts, the cards encounter a set of feed rollers. The feed rollers spaced rear of the card collection unit act to feed individual cards into the card collection unit. The rotational speed of the feed rollers is faster than the separation belts and rollers so that each card is spaced from the successive card prior to being fed to the collection unit one at a time. The space between the cards is detected by appropriately placed sensors such that the shuffler microprocessor causes cards to stop being fed to the card collection unit when a first full hand (e.g., three, five, or seven cards) has been collected.

Sensors located in the card collection unit detect the presence of cards in the card collection unit. It is from the card collection unit that the operator (e.g., dealer) of the particular card game takes the predetermined number of cards and gives them to a player. Once the cards are removed, sensor outputs cause the shuffler microprocessor to instruct the card separation and delivery unit to feed a second hand of cards and the ejector unit to eject another hand of cards. This is repeated until all players have the predetermined number of cards. Once all cards have been ejected and dealt, the operator presses a stop button to cease shuffler operation. Thereafter, once the card game is completed, all dealt cards are placed back on top of the stack of any remaining cards in the card input unit. When ready, the operator presses a go or shuffle button to begin the process for the next game.

Without random ejection technology, it has been necessary to expel all cards and re-shuffle all cards for each game played. Therefore, to the delight of players and casinos, the random ejection technology and other features of the present invention dramatically speed up the play of all card games.

BRIEF DESCRIPTION OF THE DRAWINGS

It should be understood that all drawings reflect the present invention with a housing removed.

DETAILED DESCRIPTION

Figure 1:
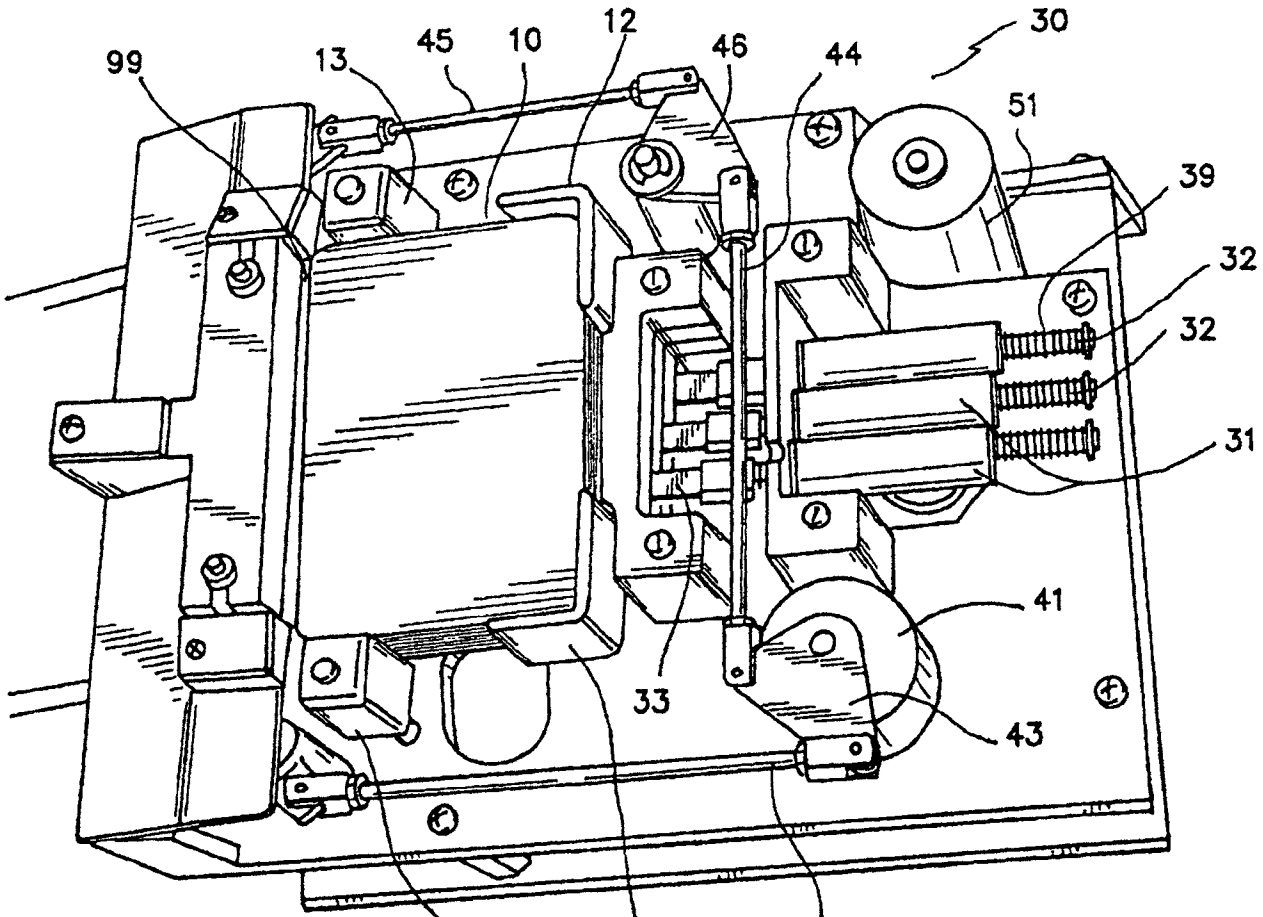
FIG. 1 is a perspective top view of an ejection unit of the present invention.

Reference is now made to the figures wherein like parts are referred to by like numerals throughout. FIG. 1 shows an automatic card ejection unit of a card shuffler. In practice, the card shuffler includes a housing to protect and conceal the internal components of the shuffler. The housing includes one or more access points for inputting cards, clearing card jams and for routine service and maintenance procedures. Moreover, the housing includes various operator input means including buttons, switches, knobs, etc., to allow the operator to interact with the shuffler. For example, an on-off button and stop and go buttons may be integrated within the housing.

It should be understood that all operations of the shuffler are controlled by an internal processing unit. Preferably, the processing unit is a microprocessor of the kind known in the art. The shuffler microprocessor is attached to a standard printed circuit board along with other electronic components (e.g., resistors, capacitors, etc.) necessary to support the microprocessor and its operations. The use of a microprocessor to control machines of all types is well-known in the art, and therefore, the specific details are not reiterated herein.

FIGS. 1-4 illustrate a card input unit 10 and card ejection unit 30 of the shuffler. Other shuffler units include a card separation and delivery unit 70 and a card collection unit 110, also referred to herein as a "card collection tray" (as shown in FIGS. 5-8A). As referred to throughout, the rear of the shuffler is defined by the card input unit 10 and ejection unit 30 and the front of the shuffler is defined by the collection unit 110.

Figure 2:
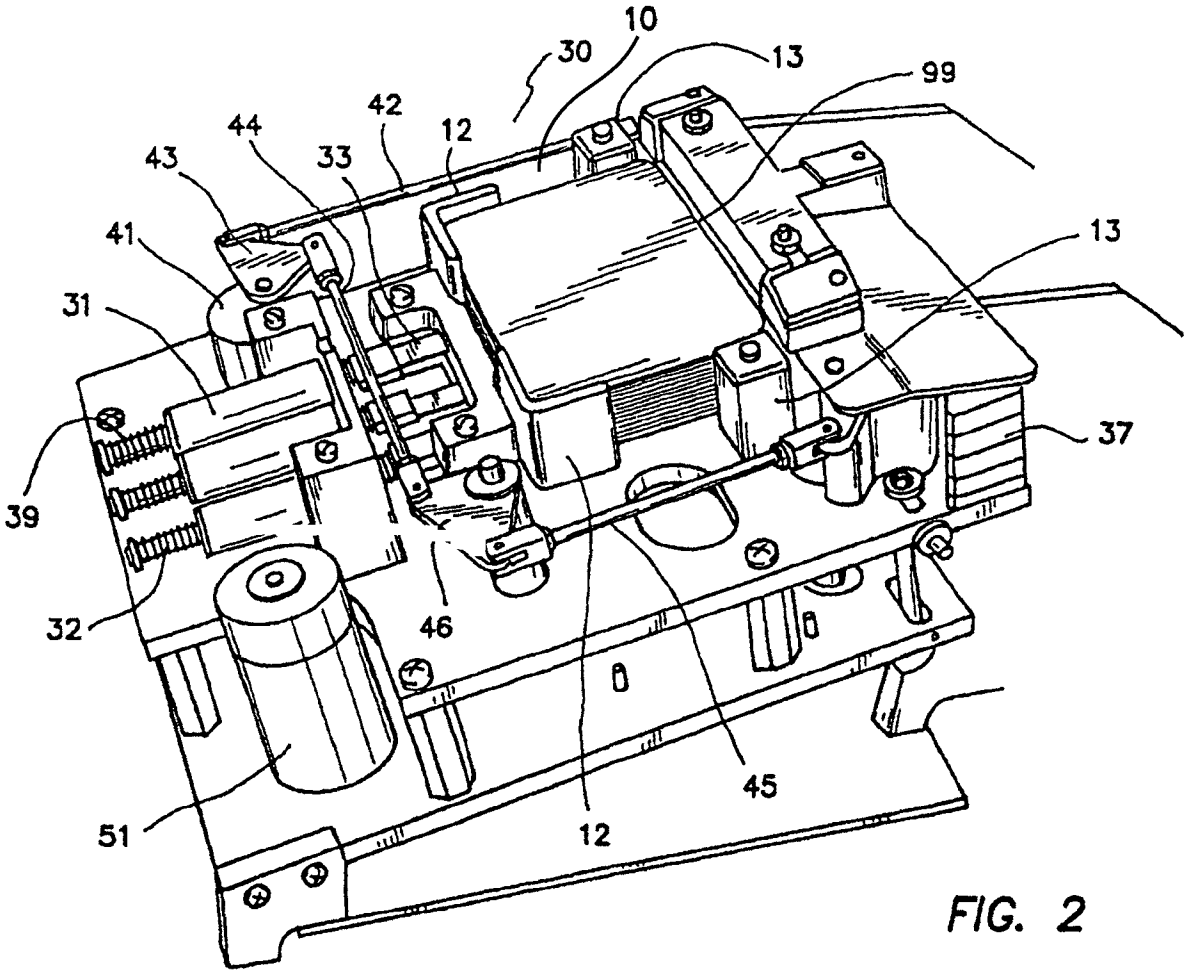
FIG. 2 is a right side perspective view of the present invention showing a card input unit and a card ejection unit.
Figure 3:
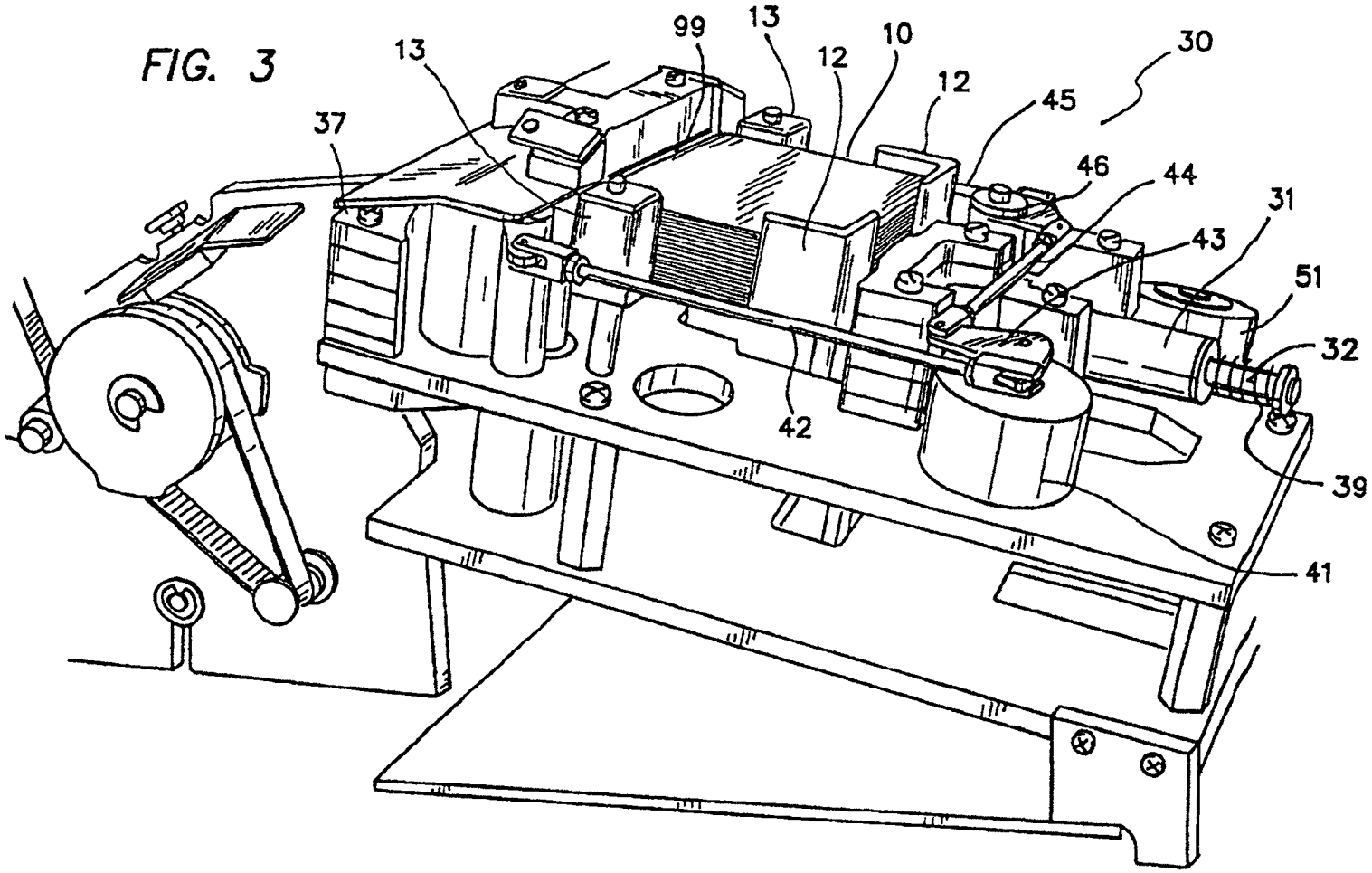
FIG. 3 is a left side perspective view of the present invention showing a card input unit and a card ejection unit.
Figure 4:
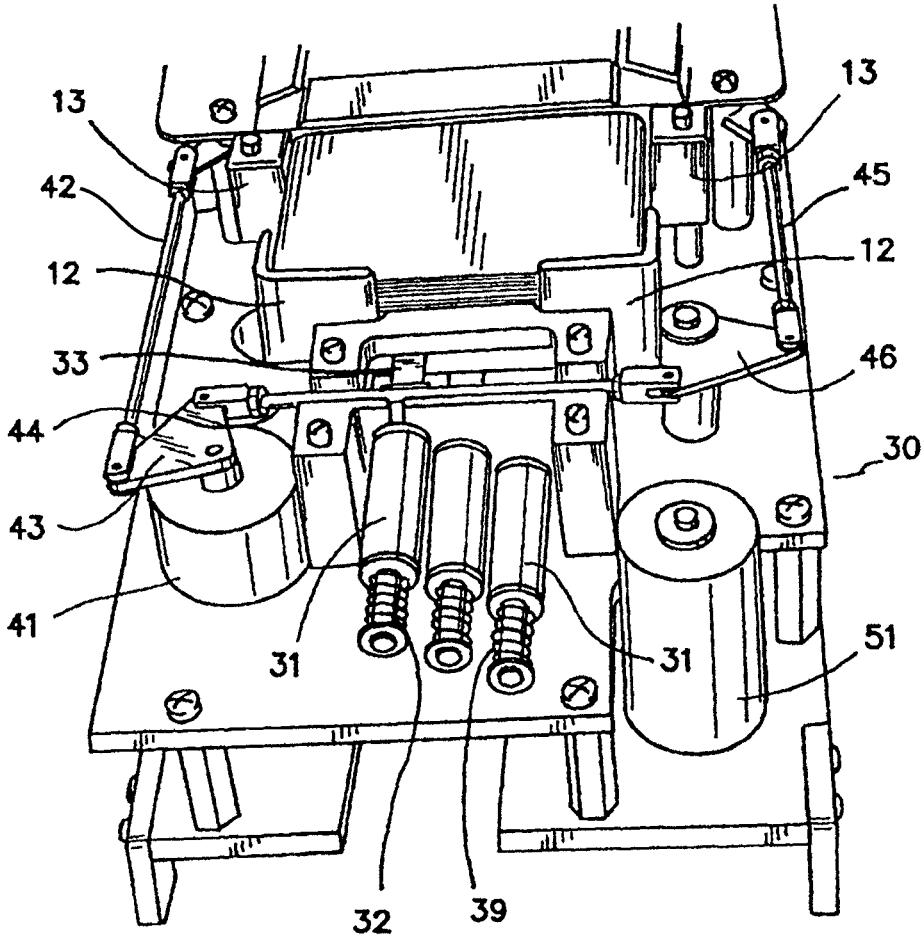
FIG. 4 is a rear perspective view of the present invention showing a card input unit and a card ejection unit.

The card input unit 10 comprises a tray 11 having two vertical angled walls 12 and two oppositely placed pillars 13 attached thereto. A stack of cards is initially placed into a recess defined by the angled walls 12 and the pillars 13. As illustrated in FIG. 2, the card input unit 10, more particularly, the underside of the tray 11, is attached to an output arm of a linear stepper motor (not shown). The linear stepper motor randomly raises and lowers the card input unit 10 for reasons that will be fully described below.

U.S. Pat. Nos. 5,584,483 and 5,676,372 are incorporated herein by this reference and provide specific details of the random ejection technology implemented in the present invention. The ejection unit 30 comprises three solenoids 31 driving three plungers 32 incorporating ejector blades 33. The solenoids 31 and corresponding ejector blades 33 are each placed at different heights to the rear of the card input unit 10.

Once a stack of cards is loaded into the card input unit 10, an operator presses an external "go," "deal," "shuffle" or "start" button to begin the ejection, separation and delivery process. A card ejecting process begins with the card input unit 10 being raised or lowered to a random location by the linear stepper motor. The random location of the card input unit 10 is based on a random number generated by the shuffler microprocessor or an independent random number generator ("RNG"). An optical sensor ensures that the card input unit 10 remains within predetermined maximum and minimum upper and lower input unit 10 positions. Once the card input unit 10 reaches a random location and stops, the solenoids 31 are activated one at a time causing the ejector blades 33 to project into the previously loaded stack of cards. Each blade 33 is designed to eject a single card from the stack. The solenoids 31 are spring-biased by springs 39 such that the ejector blades 33 automatically return to their original position after ejecting a card. Upon being ejected from the deck, each ejected card is assisted to the card separation and delivery unit 70 by two oppositely placed roller mechanisms 34A, 34B.

To prevent undue card wear and tear, in an alternative embodiment the ejection process utilizes pulse width modulation ("PWM") to control the one or more ejector blades 33. By knowing the distance from the ejector blades 33 to the loaded stack of cards, the ejector blades 33 are controlled so that the ejector blades 33 are extended to a position proximate the stack of cards. Once the ejector blades 33 are proximate the stack, the ejector blades 33 are activated to push a card from the stack. In this fashion, the impact of the blades 33 against the cards is reduced, thereby preventing undue wear and tear on the cards caused by the impact of the blade 33.

The roller mechanisms 34A, 34B are counter-rotated by a belt drive motor 51 in combination with two idler pulleys. Roller mechanism 34A contacts a first edge of a playing card, and roller mechanism 34B simultaneously contacts a second edge of a playing card. The distance between the roller mechanisms 34A, 34B is adjustable to account for different sized playing cards. A lever 55 protruding through the shuffler housing is joined to an eccentric sleeve 56 by a linkage member 52 (see FIG. 1A). The eccentric sleeve 56 is positioned below the roller mechanism 34A and may be raised in response to actuation of lever 55 thereby decreasing the distance between the roller mechanisms 34A, 34B. The adjustability of the roller mechanisms 34A, 34B prevents damage to the cards in any manner. It is imperative that cards not be damaged since damaged cards provide skilled players with an unfair advantage over the casino.

Figure 1A:
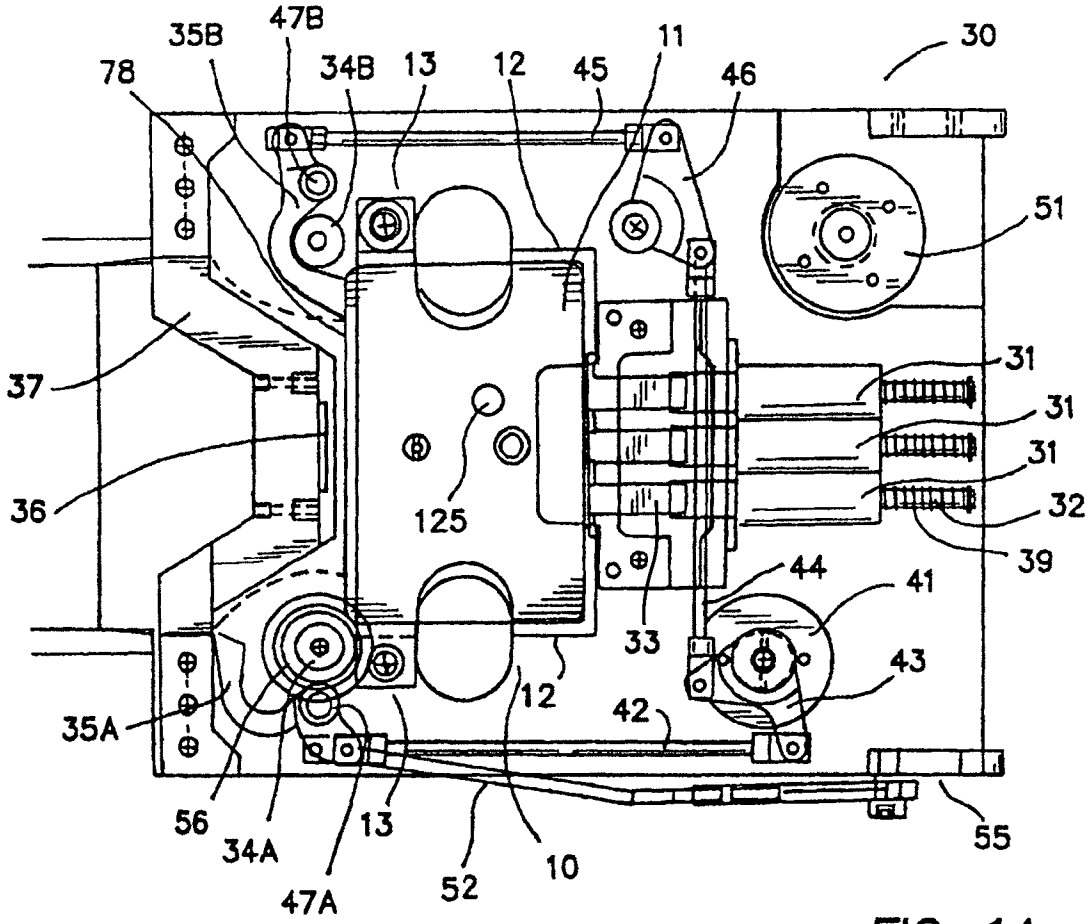
FIG. 1A is a top view of an ejection unit showing internal features of the present invention.
Figure 10:
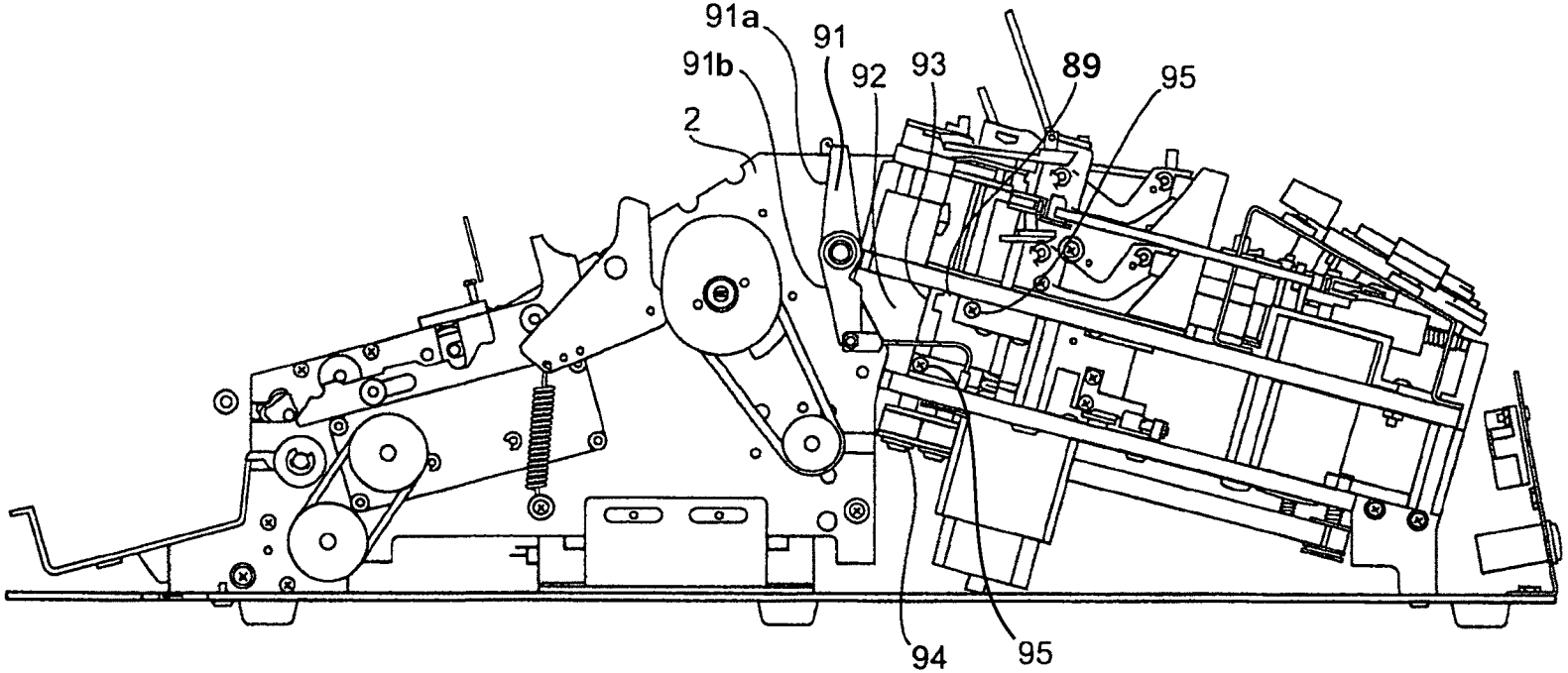
FIG. 10 shows another embodiment of a roller adjustment mechanism.

In another embodiment shown in FIG. 10, to accommodate different sized cards, the roller mechanism 34A (FIG. 1A) resides within a collar 89 in an off-set fashion. The roller mechanism 34A may then be adjusted to reduce or increase the distance between the roller mechanisms 34A and 34B (FIG. 1A). For adjusting the distance, a multi-segment lever 91, having segments 91*a* and 91*b*, is connected to arm 92, which is attached to the collar 89. By maneuvering the lever 91, namely lever segment 91*a*, the roller mechanism 34A rotates and shifts position within the collar 89. The shift in position causes the roller mechanism 34A to move away from, or toward, the opposite roller mechanism 34B. Optionally, the lever 91 may include pre-established settings that allow a user to easily adjust the lever 91 according to each pre-established incremental setting. To prevent undesired shifting of the roller mechanism 34A during use, a toothed gear 93 circumscribes an upper portion of the collar 89 such that gear teeth 94 are able to receive a securing device 95 for preventing the undesired movement. The securing device 95 may be a screw, bolt or similar device which, when inserted through a shuffler frame 2 for support, is able to then be adjusted to extend into the gear teeth 94.

Figure 11:
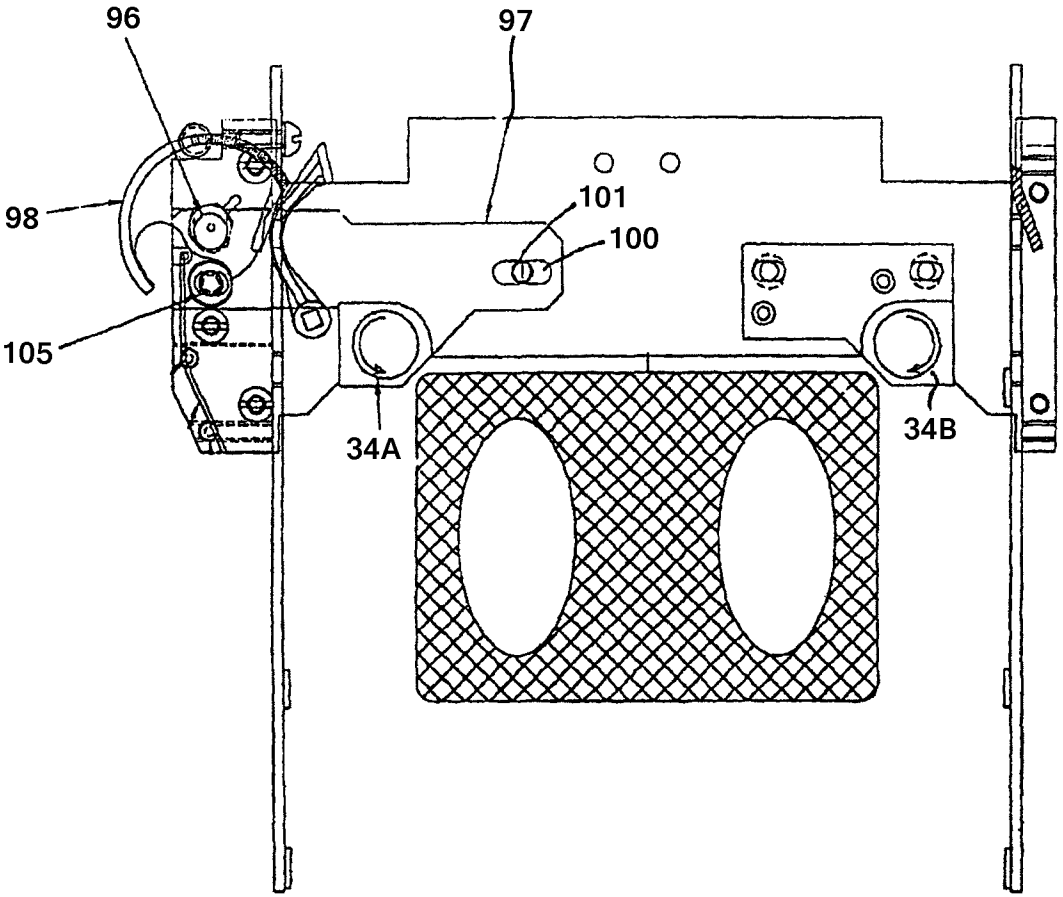
FIG. 11 shows yet another embodiment of a roller adjustment mechanism.

In an alternative embodiment shown in FIG. 11, roller mechanism 34A is adjusted by means of an eccentric hex shaft 96 rotatably attached to a bottom of the shuffler and in contact with a roller mechanism 34A support platform 97. More specifically, a portion of the hex shaft 96 resides in a cut-out in the support platform 97. As the hex shaft 96 is rotated by means of an adjustment knob 98, the support platform 97 moves in a direction away from, or toward, the opposite roller mechanism 34B. Consequently, as the support platform 97 moves, so does the supported roller mechanism 34A. Once the roller mechanism 34A is in the desired position, a lock nut 105 is tightened, thereby applying sufficient clamping pressure to the support platform 97 to prevent any undesired movement. The ability of the platform 97 to move is dictated by an elliptical cut-out 100 and pin 101 arrangement. The pin 101 is secured to the shuffler frame 2 and, along with the cut-out 100, define the degree of roller adjustment.

Although the occurrence of card jams is difficult to eliminate, the design of the shuffler drastically reduces and, in fact, minimizes the occurrence of card jams. Preventative measures include rotatable packer arms 35A, 35B and de-doublers 36 as shown in FIG. 1A. The de-doublers 36 are integrated into a de-doubler frame 37 having a plurality of horizontal slots 38 (shown in FIG. 5) for ejected cards to pass through. Each slot 38 incorporates a de-doubler 36 in the form of two vertically spaced rubber elements arranged in close proximity to prevent more than one ejected card from simultaneously passing through each horizontal slot 38.

In addition, two rotatable card packer arms 35A, 35B are placed adjacent the card input unit 10 adjacent a card eject area and opposite the placement of the solenoids 31. Sensors above and below a leading edge 99 of the card input unit 10 sense the protrusion of any cards from the card input unit 10. In response to the detection of protruding cards, the shuffler microprocessor causes the packer arms 35A, 35B to rotate in the direction of the leading edge 99 of the card input unit 10, thereby forcing the protruding cards back into the proper alignment with the remaining cards in the stack. Each packer arm 35A, 35B is physically joined to a single rotary solenoid 41 by a linkage system. A first linkage member 42 is joined to a first arm of a triangular-shaped joint 43 that is rotatably attached to the rotary solenoid 41. A second end of linkage member 42 attaches to the first packer arm 35A. Second and third linkage members 44, 45 are connected by a triangular-shaped rotatable joint 46 spaced from the rotary solenoid 41.

A first end of second linkage member 44 is attached to a second arm of the triangular-shaped joint 43 and a second end is attached to one corner of the rotatable joint 46. The third linkage member 45 is connected to a second opposite corner of the rotatable joint 46 and extends parallel to linkage member 42. The second end of the third linkage member 45 attaches to the second packer arm 35B. As the rotary solenoid 41 is instructed by the shuffler microprocessor to partially rotate in a clockwise direction, the linkage members 42, 45 each force one packer arm 35A, 35B to rotate toward the leading edge 99 of the card input unit 10. The packer arms 35A, 35B each rotate about a pivot 47A, 47B (FIG. 1A), respectively, and strike any protruding cards thereby forcing them back into the card stack.

Now referring to FIGS. 5-8A, the card separation and delivery unit 70 is defined by a shuffler frame 2 that defines the general shape of the shuffler and includes walls and a card-traveling surface 4 for guiding cards from the card input unit 10 to the card collection unit 110. Cards ejected by the ejection unit 30 traverse a fifteen degree downwardly inclined card-traveling surface 4 and encounter a rotatable U-shaped stop arm 57 blocking an entrance to the card separation and delivery unit 70. The stop arm 57 is spring-loaded about pins 58 so that a first end of the stop arm 57 contacts the card-traveling surface 4 temporarily halting the progress of the cards. The shape of the stop arm 57 is such that it facilitates the removal of any cards that may get jammed in the area of the stop arm 57. The cards reaching the stop arm 57 collect and form a stack therebehind. Importantly, the stop arm 57 is positioned such that the stack is staggered to prevent excess cards from passing under the stop arm 57 when the stop arm 57 is briefly and intermittently raised as described below.

A rotatable guide cover 8 (FIGS. 6-8) resides along an upper section of the frame 2 such that it covers the card-traveling surface 4 from the de-doubler frame 37 to a front portion of the stop arm 57. A forward end of the guide 8 is rotatably joined to the frame 2, and the rear end is releasably engaged, when closed, to magnet 9 attached to an outer surface of the frame 2 rear of the stop arm 57. The guide 8 functions to navigate ejected cards to the stop arm 57 by forming a chamber with the card-traveling surface 4.

The stop arm 57 is motor (not shown) and cam 59 driven whereby the stop arm 57 is intermittently raised from the card-traveling surface 4, allowing a predetermined number of cards to pass. A first one of the pins 58 communicates with a toggle member 60, cam 59 and spring 61 arrangement mounted to an external surface of the frame 2. As the cam 59 is rotated by the motor, a cam node 66 engages and rotates the toggle member 60, thereby causing the stop arm 57 to raise as long as the engagement continues. Once the cam node 66 disengages the toggle member 60, the stop arm 57 is returned to its original position by the spring 61 attached between the toggle member 60 and an elongated extension 63. The rotation of cam 59 is facilitated by pulley 64 and belt 65. The microprocessor controls the timing of the stop arm 57 by controlling the time of engagement between the cam node 66 and the toggle member 60.

A system of rotatable belts incorporated in a cut-out section of the card-traveling surface 4 and corresponding rollers provide means for propelling the cards from underneath a lifted stop arm 57 to the card separation and delivery unit 70 and ultimately the collection unit 110.

Figure 5:
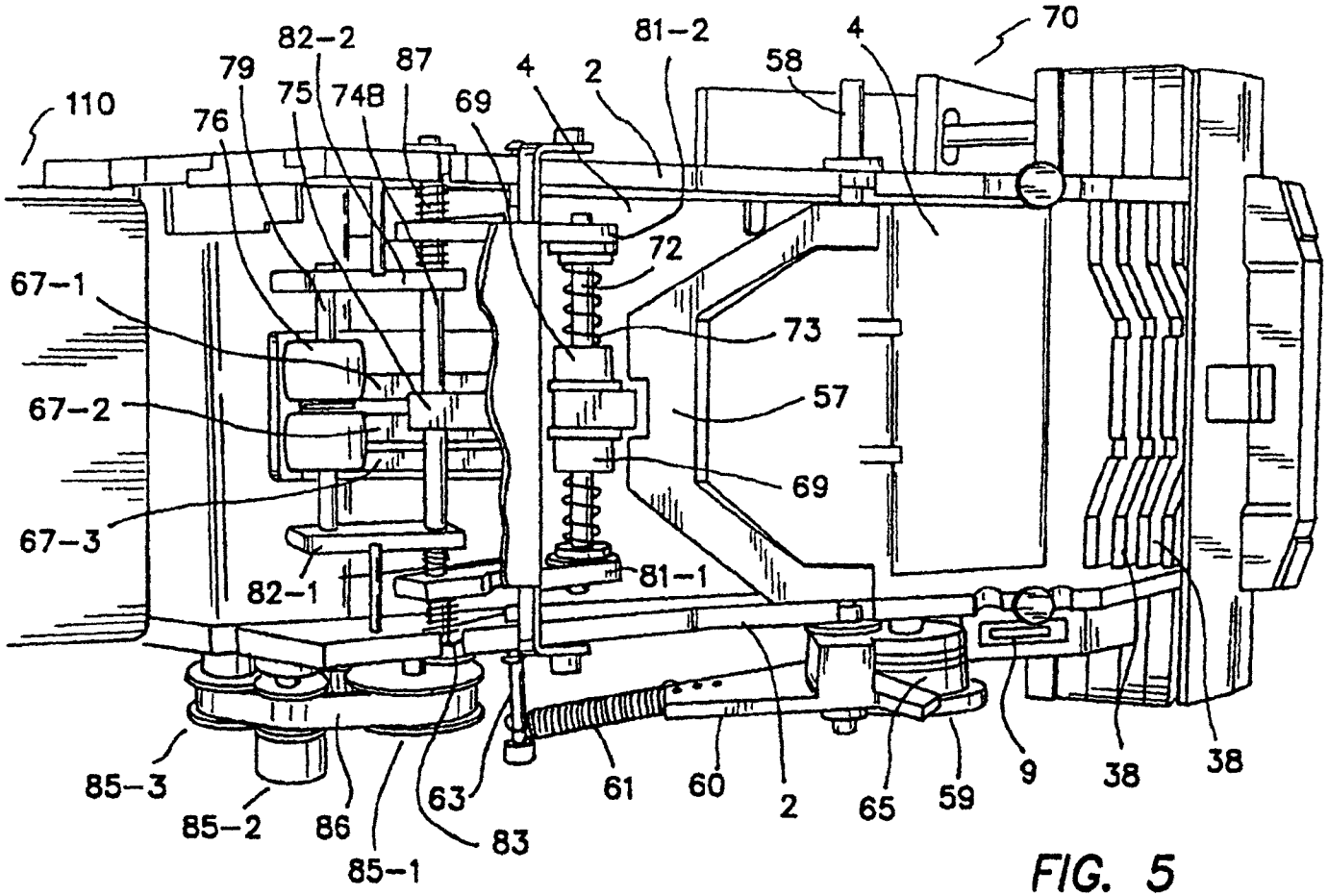
FIG. 5 is a front perspective view of the present invention showing a card separation and delivery unit and a card collection unit.
Figure 6:
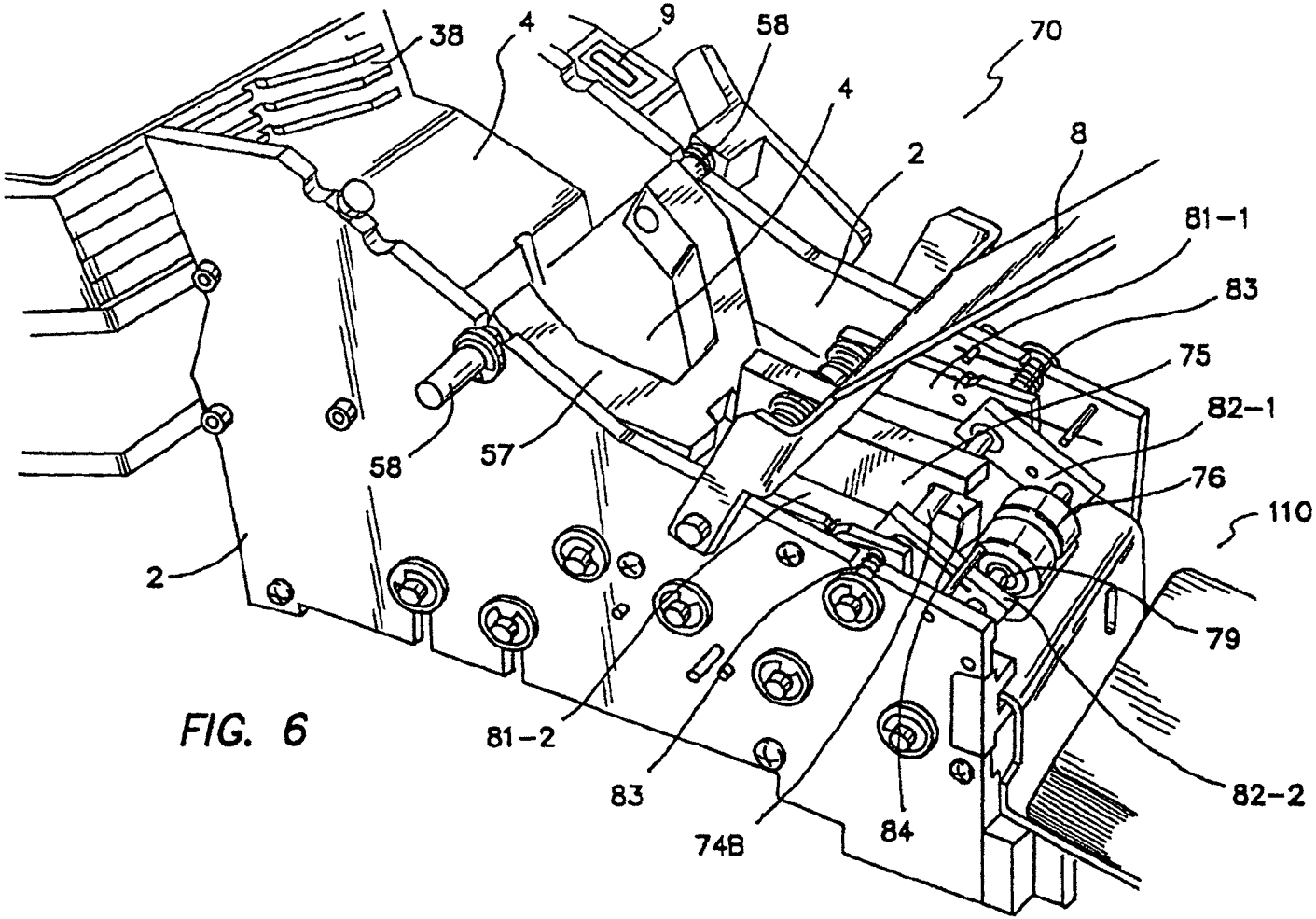
FIG. 6 is a right side perspective view of the present invention showing a card separation and delivery unit and a card collection unit.
Figure 7:
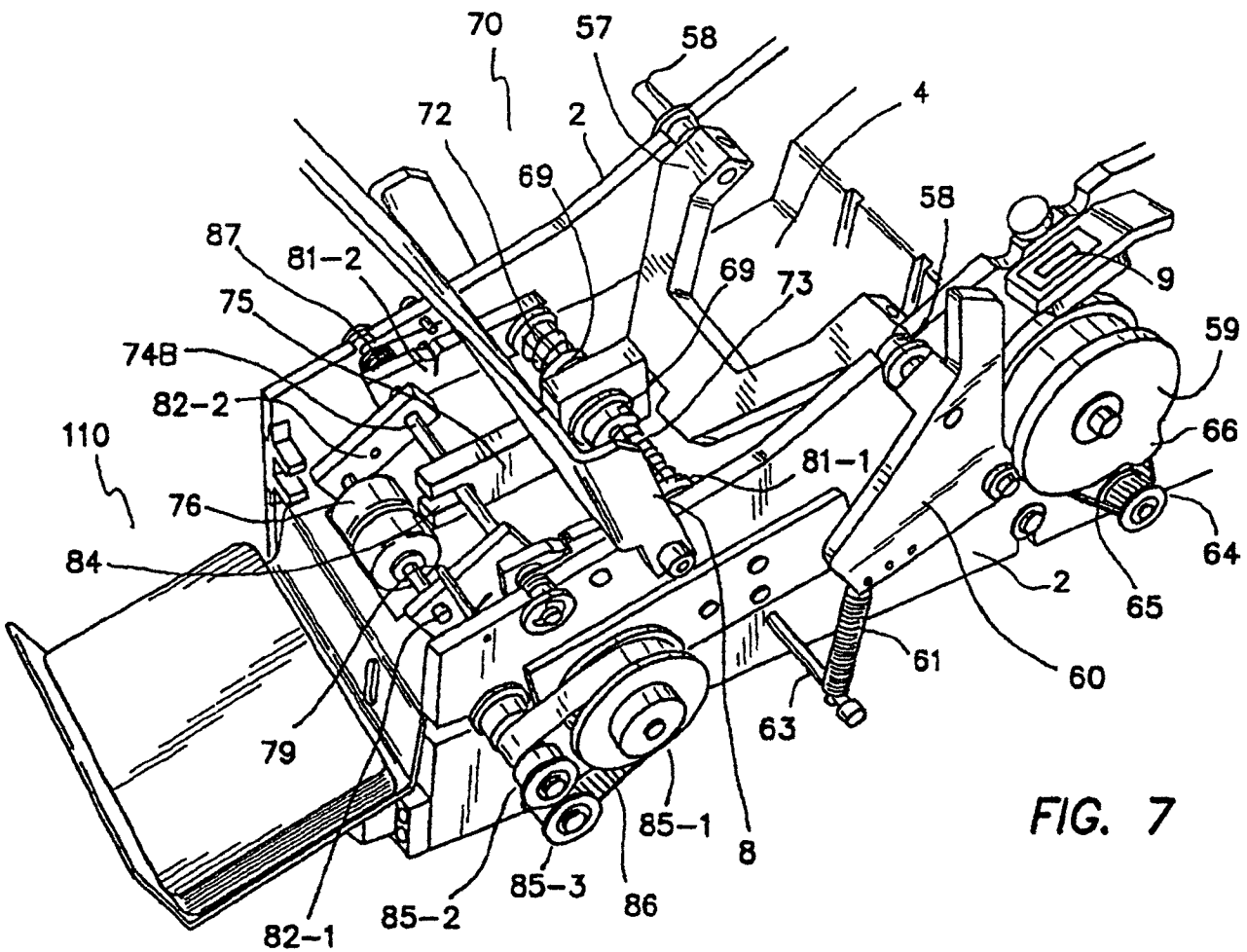
FIG. 7 is a left side perspective view of the present invention showing a card separation and delivery unit and a card collection unit.

Three parallel and spaced belts 67-1, 67-2 and 67-3 reside slightly above the planar card-traveling surface 4. Now referring to FIG. 8A, three belt pulleys 68-1, 68-2, 68-3 support the spaced belts 67-1, 67-2, 67-3 from underneath the card-traveling surface 4 as shown in FIG. 5. The front belt pulley 68-3 is adjustable, in the forward and rear directions, to account for differences in manufactured belts and belt stretching. As cards pass under the lifted stop arm 57, a first end of the rotating belts 67-1, 67-2, 67-3, in combination with two upper separation rollers 69, acts to remove and advance only a bottom card from the pack. The upper separation rollers 69 are spring-biased and supported by a first non-rotating shaft 72. Once a card passes between the separation belts 67-1, 67-2, 67-3 and separation rollers 69, the separation rollers 69 begin to stop rotating since they are no longer being acted upon by the rotating separation belts 67-1, 67-2, 67-3. Additionally, springs 73 provide friction to more hurriedly impede the movement of separation rollers 69, thereby causing separation rollers 69 to clutch all but the bottom card in the pack. A nub 90 integrated into a split of the middle belt pulley 68-2 contacts the lower most card in the stack so as to encourage the lower most card in the stack to separate from the stack. Preferably, the nub 90 operates on the bottom most card of the stack one time per revolution of the middle belt pulley 68-2.

Preferably, a centerline of the middle belt pulley 68-2 is slightly forward of a centerline of the separation rollers 69 so that a trailing edge of each passing card is forced downward by the separation rollers 69, thereby preventing the next passing card from becoming situated thereunder.

A floating gate 74 is supported by an elongated member 75 fixed at one end to the non-rotating shaft 72 and a second parallel floating gate shaft 74B spaced forward of the non-rotating separation roller shaft 72. The floating gate 74 includes a protrusion 74A extending downwardly to prevent more than three cards from fully passing under the stop arm 57 at any given time. In this arrangement, the belts 67-1, 67-2, 67-3 and the separation rollers 69 only have to manage small (e.g., three) card stacks. Thus, the risk of more than one card being propelled to the card collection unit 110 and causing a misdeal is eliminated. Moreover, the floating gate 74 also controls card jams.

Figure 8:
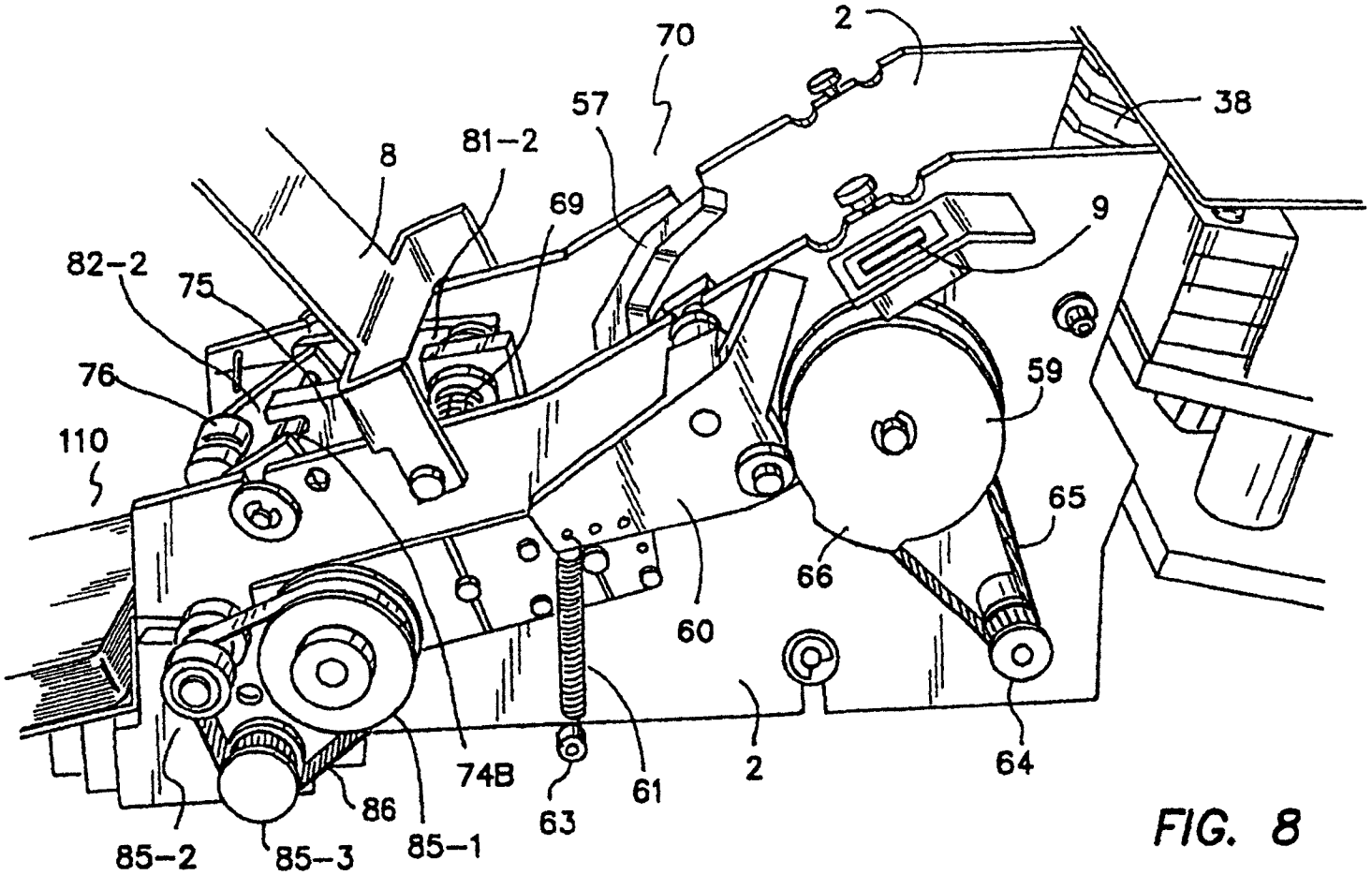
FIG. 8 is a left side perspective view of the present invention showing a card separation and delivery unit and a card collection unit.
Figure 8A:
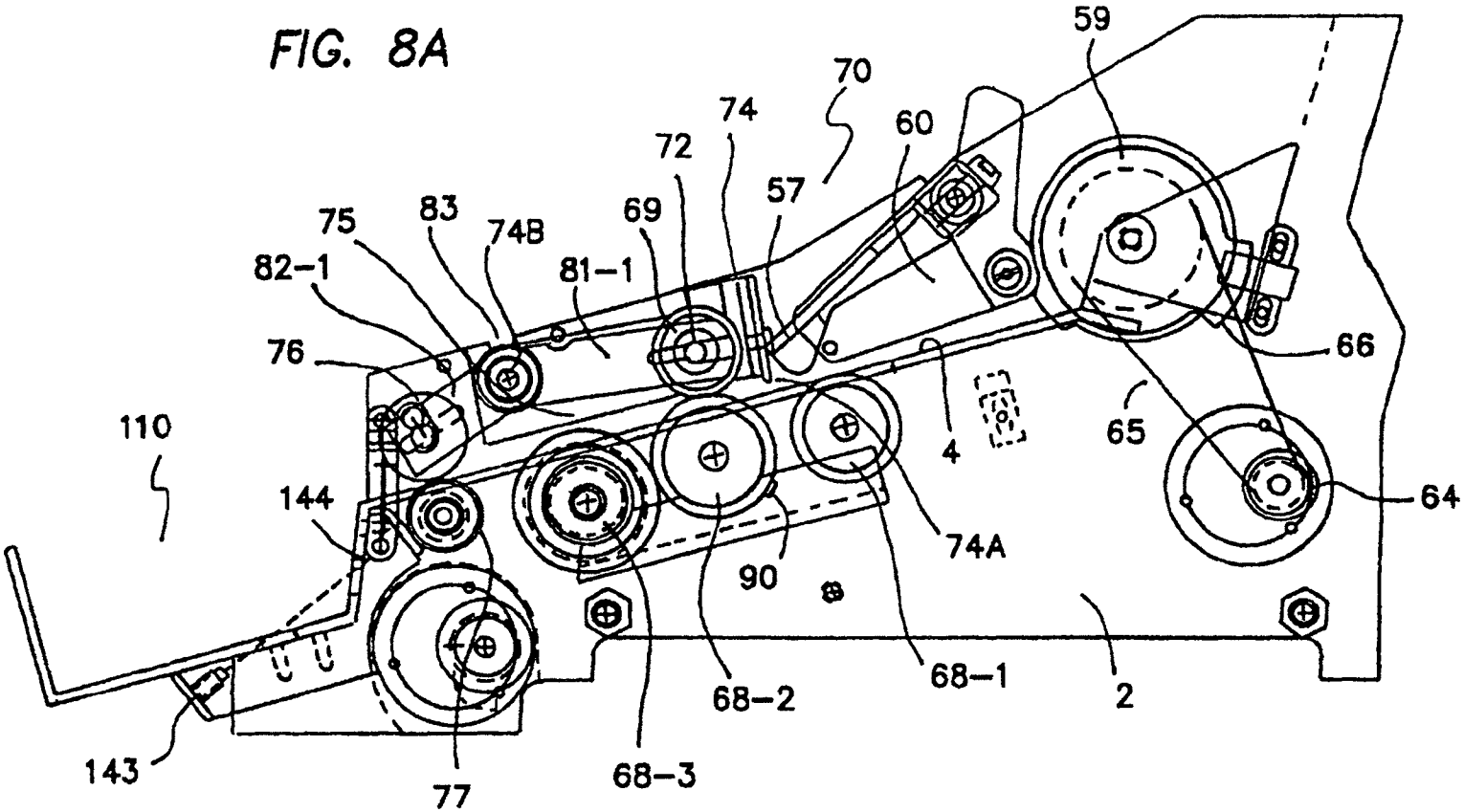
FIG. 8A is a left side view showing internal features of the present invention.

Referring to FIGS. 5 and 8A, as the cards pass under the floating gate 74, they are propelled by the belts 67-1, 67-2, 67-3 to a pair of upper feed rollers 76 and lower feed rollers 77, which counter-rotate to expel individual cards into the card collection unit 110. The upper and lower feed rollers 76, 77 grab opposite surfaces (e.g. the face and back of the card as it traverses the card-traveling surface 4) of each card and propel the card into the collection unit 110. The upper feed rollers 76 are supported by a non-rotating parallel feed shaft 79. The lower feed rollers 77 are driven at a higher speed than spaced belts 67-1, 67-2, 67-3 and separation rollers 69 so as to create separation between the trailing edge of a first card and the leading edge of a following card. As described below, it is the card separation space that sensors count to verify the number of cards fed into the card collection unit 110.

The belts 67-1, 67-2, 67-3 and lower rollers 77 are both driven by a common motor, timing belt and pulley system. A system of three pulleys 85-1, 85-2, 85-3 and a timing belt 86 are mounted on an external surface of the shuffler frame 2 and are driven by a common internal motor. The lower feed rollers 77 are acted upon by pulley 85-2 having a smaller diameter than pulley 85-1 that acts upon belts 67-1, 67-2, 67-3, thereby creating a differential in rotational speeds.

Once the separated cards pass the between the upper and lower feed rollers 76, 77 they are delivered to the card collection unit 110. The card collection unit 110 is inclined downwardly fifteen degrees so that the cards settle at the front of the collection unit 110 for easy retrieval by a dealer.

In another embodiment, the belts 67-1, 67-2, 67-3 and the upper and lower feed rollers 76, 77 are driven by individual motors (not shown). The belts 67-1, 67-2, 67-3 are preferably driven by a stepper motor and the upper and lower feed rollers 76, 77 may be driven by any suitable motor. In this arrangement, the stepper motor is temporarily shut down in response to a card being propelled from the shuffler into the card collection tray 110. As discussed below, sensors detect cards exiting the shuffler into the card collection tray 110. Consequently, the upper and lower feed rollers 76, 77, which continue to run during the entire shuffling and dealing process, hurriedly pull the card through a front portion of the card delivery unit 70 as the belts 67-1, 67-2, 67-3 remain static. Then, once the card passes into the card collection tray 110, the stepper motor (not shown) fires up again causing the belts 67-1, 67-2, 67-3 to act on the next card. Thus, the belts 67-1, 67-2, 67-3 are not acting upon the next card until the stepper motor starts again. Based on sensor data, the microprocessor instructs the stepper motor to stop and start accordingly. This system facilitates complete separation of cards, thereby preventing multiple overlapping cards from being dealt and counted as a single card by sensors. That is, should the improper number of cards, according to the game being played, pass into the card collection tray 110, a misdeal would be declared. For obvious reasons, casinos and related gaming establishments do not favor misdeals.

With the two motor embodiment, the system of three pulleys 85-1, 85-2, 85-3 and the timing belt 86 is replaced with two individual two pulley systems each having a single belt (not shown). In a first design, the first two pulleys and corresponding belt for driving the upper and lower feed rollers 76, 77 are mounted externally on a first side of the shuffler frame 2 and the second two pulleys and belt for driving the belts 67-1, 67-2, 67-3 are mounted on an opposite side of the shuffler frame 2. However, both pulley systems may be mounted on a common external side of the shuffler frame 2.

The separation shaft 72, floating gate shaft 74B, feed shaft 79, separation rollers 69 and upper feed rollers 76 are joined by two pairs of elongated bars. A first set of bars 81-1, 81-2 rotatably join the outer portions of the separation shaft 72 to the outer portions of the floating gate shaft 74B. A second set of bars 82-1, 82-2 join the floating gate shaft 74B to the outer portions of the feed shaft 79. The floating gate shaft 74B is further supported by opposite notches 83 in the frame 2. In this manner, card jams may be physically cleared by an operator by lifting the floating gate shaft 74B thereby causing the separation shaft 72 to move forward and upward. An open slot 84 in the elongated member 75 further allows the elongated member 75 to be rotated away from the floating gate shaft 74B revealing the card separation and delivery unit 70 for card removal. Springs 87 incorporated between outer surfaces of the first bars 81-1, 81-2 and inner surfaces of the frame 2 return the floating gate shaft 74B to its original position after a card jam is cleared.

Multiple sensors are incorporated throughout the shuffler to track the progression of the cards, inform an operator of shuffler status and to alert the operator of any internal problems. A first, preferably optical reflective, sensor 125 (FIG. 1A) is positioned beneath the card input unit 10 to sense the input of cards into the unit 10. During normal operation the shuffler will not function until sensor 125 detects the presence of cards in card input unit 10. A first pair of sensors (emitter and detector) above and below a leading edge of the card input unit 10 senses the presence of protruding cards from within the card input unit 10. The shuffler microprocessor activates the packer arms 35A, 35B in response to outputs from the first pair of sensors.

A second pair of sensors spaced forward of the first pair of sensors detects the ejection of cards from the card input unit 10. The second pair of sensors detects the number of ejected cards. The number of cards ejected is predetermined based on the underlying card game being dealt. The shuffler microprocessor stops the ejection process once outputs from the second pair of sensors indicate that two hands of cards have been ejected. The number of cards per hand is a function of the underlying wagering game being played. As described below, the shuffler microprocessor re-starts the ejection process in response to an output from a more forward pair of sensors.

Once two hands of cards have been ejected from the card input unit 10, they come to rest, in a staggered stacked fashion, against or adjacent to the card stop arm 57. As the second pack is completely delivered to the card stop arm 57, outputs from the second pair of sensors inform the shuffler microprocessor that the two hands have been ejected and to lift the stop arm 57. The raising of the stop arm 57 permits the previously ejected cards to partially pass under the stop arm 57 to the floating gate 74. Thereafter, the belts 67-1, 67-2, 67-3 and upper and lower feed rollers 76, 77 propel the bottom card of the stack to the card collection unit 110 until a first hand has been fed to the card collection unit 110. A third pair of sensors (not shown) are located adjacent a card exit area such that the third pair of sensors detects the number of cards being delivered to the card collection unit 110. Once a first hand is delivered to the card collection unit 110, the shuffler microprocessor, using outputs from the third pair of sensors, stops delivering cards to the card collection unit 110 and re-starts the ejection process. A fourth pair of sensors 143, 144 (FIG. 8A), located in the collection unit 110 detects the presence or absence of cards therein. Once a dealer removes the first card hand from the collection unit 110, the shuffler microprocessor, using outputs from the fourth pair of sensors 143, 144 resumes delivering cards to the card collection unit 110.

The sensor and shuffler microprocessor driven process described continues until the requisite number of hands are delivered to the card collection unit 110 and distributed by the dealer. Once the requisite number of hands has been delivered and dealt, the dealer presses a stop button on the shuffler to stop further card delivery. In an alternative fashion, the shuffler housing may incorporate a re-eject button that the operator may press prior to each hand being ejected. In either embodiment, the ejection unit 30 only need deal the exact number of cards required for the game and number of players playing the game. Thereafter, the ejection technology allows the operator to simply place the played cards on top of the remaining cards in the card input unit 10 and press the go button for the next game. Previous card shufflers require that all cards be shuffled and delivered for each game played. The random ejection technology of the present invention greatly reduces the time between game plays.

Additional sensors are placed along the card separation and delivery unit 70 to detect the occurrence of a card jam or other dealing failure. Upon the determination that a card jam has occurred, the operator can be notified in any number of ways, including the use of LED indicator lights, segmented and digital displays, audio outputs, etc. In one embodiment, the present invention relies on audio outputs in the form of computer generated voice outputs to alert the operator of a card jam or to instruct the operator regarding the status of the shuffler.

As set forth above, the preferred method of notifying a shuffler operator of a card jam or the status of the current shuffle cycle is through an internal audio system. Now referring to FIG. 9, the internal audio system utilizes a second microprocessor 151, preferably a 32-bit microprocessor, interfaced with the shuffler microprocessor 150. The preferred interface 152 is an RS-232 bi-directional serial interface. The second microprocessor 151 runs the audio system and a video capture imaging system fully described in U.S. patent application Ser. No. 10/067,794, now U.S. Pat. No. 6,886,829, incorporated herein by reference.

A flash storage card 153 stores digital audio messages, in any language, and communicates said messages to the second microprocessor through a 32-bit bus 154. The messages are retrieved by the second microprocessor 151 in response to commands by microprocessor 150. Microprocessor 150 relies on the outputs of the multiple shuffler sensors for instructing the second microprocessor 151. For example, should a sensor detect a card jam, the output of the sensor will cause microprocessor 150 to communicate with microprocessor 151 instructing the latter that an audio message is required. Microprocessor 151 will then retrieve the appropriate message, possibly a message stating "CARD JAM," from the flash storage card 153 and send the same to a codec 156 (coder-decoder) for converting the retrieved digital audio signal to an analog signal. The analog audio signal is then transmitted via a speaker 155.

The microprocessor 150 also communicates to a flash-based field programmable gate array 157 through a second 32-bit bus 158. The flash-based field programmable gate array 157 further communicates with a repeat switch 159 incorporated with the shuffler housing. The repeat switch 159 allows an operator to re-play the previous audio message. The repeat switch 159 feature is beneficial during shuffler use in a loud casino environment.

It is contemplated that stored audio messages besides "CARD JAM" may include "READY TO SHUFFLE," "REMOVE FIRST HAND," "REMOVE SECOND HAND," "INPUT CARDS," etc. The number of possible audio messages depends solely on the various sensor outputs since the sensors provide microprocessor 150 with the status of the shuffler at any given time. In a more limited application the audio system can be used to communicate game-related information to an operator. For example, the card game known as pai gow requires that a number between one and seven be randomly chosen prior to the deal of the game's first hand. The random number determines which player position, and therefore which player, receives the first hand out of the shuffler. Typically, dice or random number generators in communication with a display means have been used to generate and communicate the random number to an operator and players. The audio system allows the microprocessor 150 to randomly generate a number between one and seven, communicate the number to microprocessor 151, which sends the number to the codec 154, which causes the speaker 155 to output the number in audio form. The repeat switch 159 is very useful in this limited application because the number is absolutely essential to properly play the game of pai gow. Therefore, the inability to re-play an unheard or disputed number could cause great confusion and consternation for players.

Figure 9:
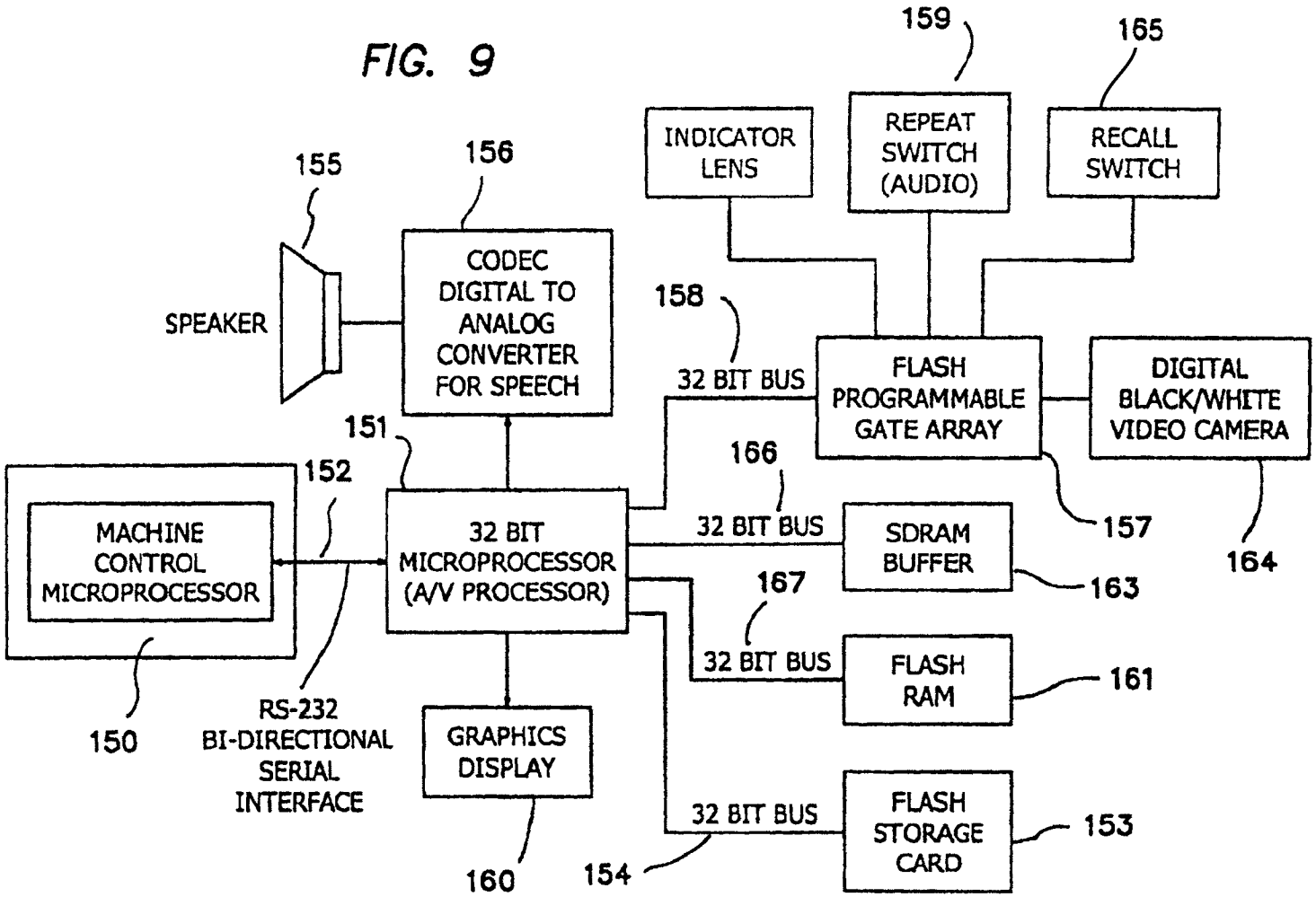
FIG. 9 is a block diagram showing an audio output system of the present invention.

Also illustrated in FIG. 9 are the various components of an image capturing system, including a graphics display 160, flash RAM 161, SDRAM buffer 163, digital (black/white) video camera 164 and hand recall switch 165. The flash RAM 161 initially stores digital images of every dealt card as they are captured by the digital camera 164. The SDRAM buffer 163 then stores and assembles the captured images. The images captured by the digital camera 164 are sent to the flash-based field programmable gate array 157, which uses gray-scale compression to compress the images. The compressed images are then sent via 32-bit bus 158 to microprocessor 151, which then sends the compressed images to the SDRAM buffer 163 and/or the flash RAM 161 via 32-bit buses 166, 167. When desired, the operator presses the hand recall switch 165 incorporated in the shuffler housing to display the captured images, in order of deal, on display 160.

Although the invention has been described in detail with reference to a preferred embodiment, additional variations and modifications exist within the scope and spirit of the invention as described and defined in the following claims.

What is claimed is:

1. An apparatus for randomly arranging and dealing groups of playing cards, comprising:

a card input unit for receiving unrandomized cards;

a randomization system for randomly arranging cards from the card input unit;

a card collection unit for receiving cards from the randomization system;

a card sensor positioned and configured to sense at least one of presence and absence of cards in the card collection unit;

a user input configured to, upon activation, result in at least delivery or stopping delivery of a group of cards to the card collection unit; and a processor in information communication with the card sensor and the user input, the processor configured to control operation of the apparatus and, in response to a signal from at least one of the card sensor and the user input, to direct the apparatus to deliver the first group of cards to the card collection unit, and, in response to a signal from the card sensor, to direct the apparatus to deliver at least a second group of cards to the card collection unit;

wherein the apparatus is configured to randomize cards received in the card collection unit for a first game and returned to the card input unit for use in a second game without removing cards remaining in at least one of the card input unit and the randomization system from the first game.

2. The apparatus of claim 1, wherein the randomizing system comprises a card ejection unit configured to randomly eject cards from the card input unit.

3. The apparatus of claim 2, wherein the card ejection unit comprises at least one solenoid positioned to push cards from a stack of cards in the card input unit.

4. The apparatus of claim 1, further comprising a card moving system for moving cards from the randomization system to the card collection unit.

5. The apparatus of claim 4, wherein the card moving system is configured to move cards individually to the card collection unit.

6. The apparatus of claim 4, wherein the card moving system comprises at least one of powered rollers and powered belts.

7. The apparatus of claim 1, wherein each of the first group of cards and the at least a second group of cards comprises a hand of two to seven cards.

8. The apparatus of claim 1, wherein the card sensor comprises a pair of sensors.

9. The apparatus of claim 1, further comprising a card sensor configured to detect a number of cards delivered to the card collection unit.

10. An automatic card shuffler, comprising:

a card input unit for receiving a stack of cards;

a card ejection unit for randomly ejecting cards from the stack of cards in the card input unit;

a card collection unit for receiving cards from the card input unit to be dealt in a card game;

a card delivery unit configured to move cards randomly ejected from the card input unit to the card collection unit;

a card sensor positioned and configured to sense at least one of presence and absence of cards in the card collection unit; and a processor in information communication with the card sensor, the processor configured to control operation of the automatic card shuffler and, in response to a signal from the card sensor, to direct the card delivery unit to deliver sets of cards to the card collection unit and to direct the card ejection unit to randomly eject cards, wherein the automatic card shuffler is configured to deliver cards to the card collection unit during multiple card games without removing all cards remaining in the card input unit between the multiple card games.

11. The automatic card shuffler of claim 10, wherein the card ejection unit comprises fixed card ejectors and a movable card input tray for moving cards in the movable card input tray relative to the fixed card ejectors.

12. The automatic card shuffler of claim 11, wherein the processor is configured to randomly select a location to move the movable card input tray relative to the fixed card ejectors.

13. The automatic card shuffler of claim 10, wherein the processor is configured to direct the card delivery unit to stop delivery of sets of cards to the card collection unit upon receipt of a signal from a user input.

14. The automatic card shuffler of claim 10, further comprising a user input configured, upon activation, to result in delivery or stop delivery of a group of cards to the card collection unit.

15. A method of randomly arranging and delivering groups of cards, the method comprising:

receiving unshuffled cards in a card input unit of a card shuffler;

delivering randomly formed sets of cards from the card input unit to a card collection unit of the card shuffler for use in a game;

after the randomly formed sets of cards delivered to the card collection unit are used in a game, receiving the used cards in the card input unit without removing remaining cards from the shuffler; and after receiving the randomly formed sets of cards in the card input unit, delivering additional randomly formed sets of cards from the card input unit to the card collection unit for use in another game.

16. The method of claim 15, further comprising randomly selecting a number of cards in the set to be delivered from the card input unit to the card collection unit using a user input.

17. The method of claim 15, wherein delivering randomly formed sets of cards from the card input unit to the card collection unit comprises randomly ejecting cards from the card input unit.

18. The method of claim 15, wherein delivering randomly formed sets of cards from the card input unit to the card collection unit comprises:

delivering a first random set of cards to the card collection unit;

sensing removal of the first random set of cards from the card collection unit; and upon sensing removal of the first random set of cards from the card collection unit, delivering a second random set of cards to the card collection unit.

19. The method of claim 15, wherein delivering randomly formed sets of cards from the card input unit to the card collection unit comprises delivering at least one hand of cards to the card collection unit for delivery to at least one respective player of the game.

20. The method of claim 15, wherein delivering randomly formed sets of cards from the card input unit to a card collection unit comprises individually moving cards of each set of cards into the card collection unit.

21. The method of claim 15, further comprising receiving a user input resulting in the delivery of the randomly formed sets of cards from the card input unit to the card collection unit.

* * * * *